US007210325B2

(12) United States Patent
Brieschke et al.

(10) Patent No.: US 7,210,325 B2
(45) Date of Patent: May 1, 2007

(54) TUBE THREAD FORMING APPARATUS AND METHOD

(75) Inventors: Todd M. Brieschke, Ottawa Lake, MI (US); David G. Copeman, Sterling Heights, MI (US)

(73) Assignee: Aries Engineering Company, Inc., Dundee, MI (US)

( * ) Notice: Subject to any disclaimer, the term of this patent is extended or adjusted under 35 U.S.C. 154(b) by 140 days.

(21) Appl. No.: 11/022,423

(22) Filed: Dec. 27, 2004

(65) Prior Publication Data

US 2006/0137425 A1 Jun. 29, 2006

(51) Int. Cl.
*B21J 7/16* (2006.01)

(52) U.S. Cl. ..... 72/401; 72/353.6; 72/354.2; 72/370.04; 72/370.05

(58) Field of Classification Search ..... 72/401, 72/398, 427, 370.21, 370.04, 370.05, 370.08, 72/353.4, 353.6, 354.2, 400; 413/23, 24
See application file for complete search history.

(56) References Cited

U.S. PATENT DOCUMENTS

| | | | | | |
|---|---|---|---|---|---|
| 279,118 | A * | 6/1883 | Allen | 72/401 |
| 1,268,789 | A * | 6/1918 | Bryant | 72/401 |
| 1,368,890 | A * | 2/1921 | Canfield | 72/401 |
| 1,823,047 | A * | 9/1931 | Hothersall | 29/523 |
| 3,254,619 | A * | 6/1966 | Green | 413/23 |
| 5,694,802 | A * | 12/1997 | Tanaka et al. | 72/353.6 |

* cited by examiner

*Primary Examiner*—Daniel C. Crane
(74) *Attorney, Agent, or Firm*—MacMillan, Sobanski & Todd, LLC

(57) ABSTRACT

A tube partial thread forming apparatus and method is disclosed. A tube is placed on the apparatus around internal die sections, which are separated by a mandrel to cause the internal die sections to engage the tube. stripper pieces are moved into engagement around the outer surface of the tube to secure and support the tube. External die sections extend through the stripper pieces and engage the tube and form partial threads thereon.

18 Claims, 5 Drawing Sheets

TUBE THREAD FORMING APPARATUS AND METHOD

BACKGROUND OF INVENTION

The present invention relates to an apparatus and method for forming threads in a tube.

There are tubes employed in various applications where the tubes require a very limited number of relatively course (partial) threads on one end. For example, a fuel filler tube that extends from a vehicle fuel tank to an opening in the side of the vehicle will have threads at one end for securing a mating part thereto. It may be desirable for the mating part to only need, for example, one quarter or one half turn to be fully engaged with the tube. The threads, then, may each extend only part of the way around the circumference of the tube. In such tubes, a metal forming operation is employed to form these partial threads rather than cutting threads into the tube, as may be the case with tubes that have a full set of threads on their ends.

In the past, such tubes with these partial threads may have been roll formed, or have the threads formed in a six-segment die actuated by a large press. But these processes have drawbacks, including, for example, a limited ability to adapt to changes in tube outside diameters, and a limited ability to detect an out of tolerance part before or during the thread forming process. Still other forming processes mate one side of the tube with a die and apply pressure via a second die being pressed from the opposite side. But such asymmetrical processes do not always produce the desired result. Since these partial threads are not necessarily formed all of the way around the tube, there is not equal pressure all of the way around, so the tube may tend to deform to an oval shape at the location of the threads.

Thus, it is desirable to form partial threads on a tube while overcoming the drawbacks of the prior art.

SUMMARY OF INVENTION

In its embodiments, the present invention contemplates a partial thread forming apparatus for forming partial threads on a tube. The apparatus may comprise a base having a first arm and a second arm spaced from the first arm, and a prime motive apparatus fixed relative to the base and having a controllable shaft extending therefrom. The apparatus may also include a thread forming assembly located generally between the first arm and the second arm. The thread forming assembly may include a first end plate connected to and movable by the controllable shaft, a second end plate affixed to the second arm, an internal die located between the first and second end plates and sized to be insertable within the tube, a first external die mounted to the first end plate and having a first flange with a first forming surface extending toward the internal die, a second external die mounted to the second end plate and having a second flange with a second forming surface extending toward the internal die, a first stripper piece elastically coupled to the first end plate and including a first securing surface extending adjacent to the first forming surface and adapted to support the tube, and a second stripper piece elastically coupled to the second end plate and including a second securing surface extending adjacent to the second forming surface and adapted to support the tube.

An embodiment of the present invention also contemplates a partial thread forming apparatus for forming partial threads on a tube, with the apparatus including a base having a first arm and a second arm spaced from the first arm, and a prime motive apparatus fixed relative to the base and having a controllable shaft extending therefrom. The partial thread forming apparatus may also include a thread forming assembly located generally between the first arm and the second arm and including a first end plate connected to and movable by the controllable shaft; a second end plate affixed to the second arm; an internal die located between the first and second end plates and sized to be insertable within the tube, with the internal die including a first half and a separate second half; a mandrel located between the first half and the second half and adapted to be operable to move the first and second halves in opposed directions into contact with the tube; a first external die mounted to the first end plate and having a flange extending toward the internal die; a second external die mounted to the second end plate and having a flange extending toward the internal die; a first stripper piece coupled to the first end plate and including a first securing surface adapted to support the tube; and a second stripper piece coupled to the second end plate and including a second securing surface adapted to support the tube.

An embodiment of the present invention additionally contemplates a method of forming partial threads in a tube having an inner surface and an outer surface, the method comprising the steps of: locating a portion of the tube around an internal die having a first half and an opposed separate second half and partial teeth forming recesses located thereon; moving the first half and the second half apart and into contact with the inner surface of the portion of the tube; engaging the outer surface of the portion of the tube with support surfaces of a pair of opposed stripper pieces; engaging the outer surface of the portion of the tube, with a first and a second forming surface of a respective first and opposed second external die, adjacent to the corresponding support surfaces of the pair of stripper pieces to thereby form partial threads in the tube; and releasing the tube from the first and second external dies, the pair of stripper pieces and the internal die.

An advantage of an embodiment of the present invention is that equal force is applied to opposite sides of the tube in order to improve the result of the forming operation.

A further advantage of an embodiment of the present invention is that the tendency of the tube to deform to an oval during the thread forming operation is significantly reduced.

An additional advantage of an embodiment of the present invention is that some out of tolerance parameters can be detected just prior to the thread forming operation and prevent the operation if tolerance is out of a desired range. Moreover, out of tolerance parameters may be detected during the forming operation, allowing such tubes to be rejected if unsatisfactory.

Another advantage of an embodiment of the present invention is that different size tubes, which have small differences in diameter, can have partial threads formed thereon by this apparatus and method.

DETAILED DESCRIPTION

Figure 1:
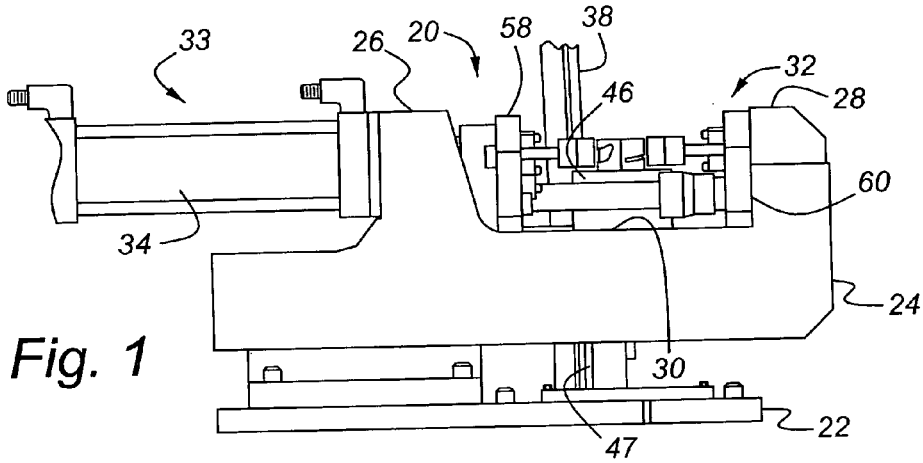
FIG. 1 is a side elevation view of the tube thread forming apparatus in accordance with an embodiment of the present invention.
Figure 2:
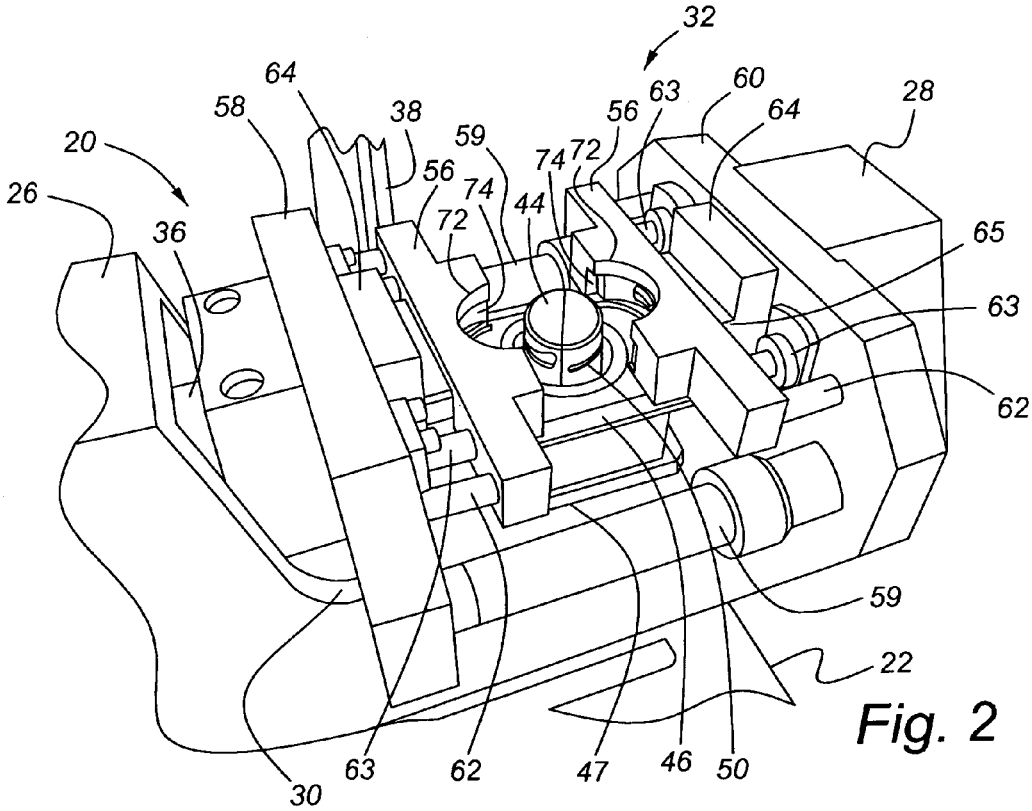
FIG. 2 is a perspective view of the thread forming apparatus of FIG. 1.
Figure 3:
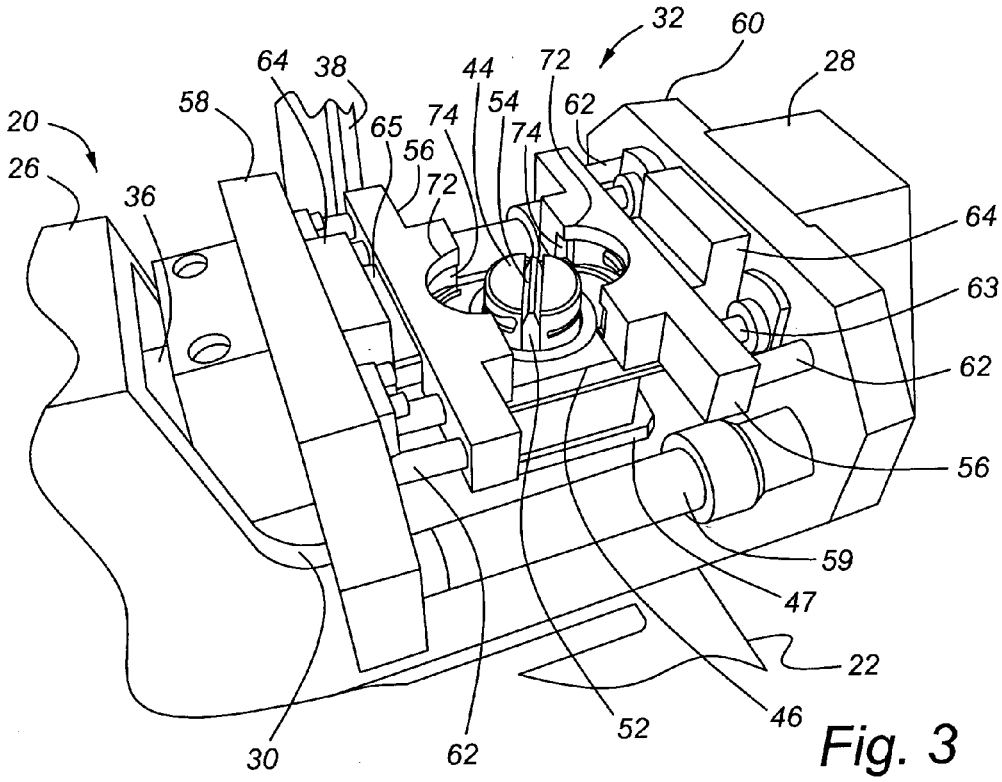
FIG. 3 is a perspective view similar to FIG. 2, but illustrating a mandrel in its actuated position.
Figure 4:
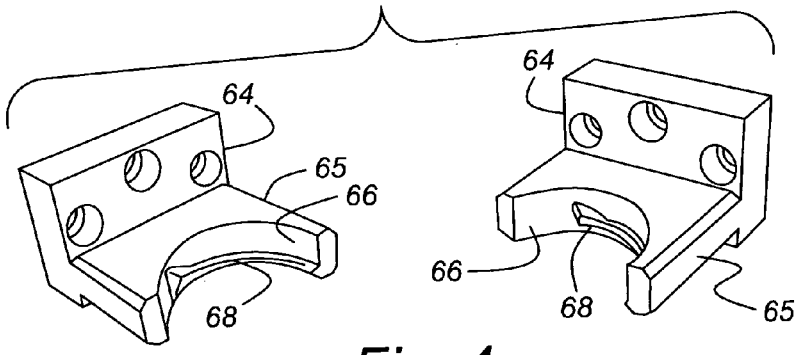
FIG. 4 is a perspective view of a pair of external dies in accordance with an embodiment of the present invention.

FIGS. 1–7 illustrate a tube thread forming apparatus, indicated generally at 20. The apparatus 20 includes a base 22 upon which a main support structure 24 is securely mounted. The main support structure includes a first arm 26 and a second arm 28 that form a cradle 30, within which is mounted a forming assembly 32.

A pneumatic assembly 33 is mounted to the first arm 26 and extends from one end of the support structure 24. The pneumatic assembly 33 includes a pneumatic cylinder 34 and a shaft 36 in engagement with the forming assembly 32. The connections and operation of the pneumatic assembly 33 are known to those skilled in the art and so will not be discussed further herein. While the pneumatic assembly 33 is illustrated as the prime motive apparatus, other suitable apparatuses may be employed instead, if so desired. For example, a hydraulic, mechanical or electromechanical driver (not shown) may be employed for controlling the motion of the shaft 36.

Figure 5:
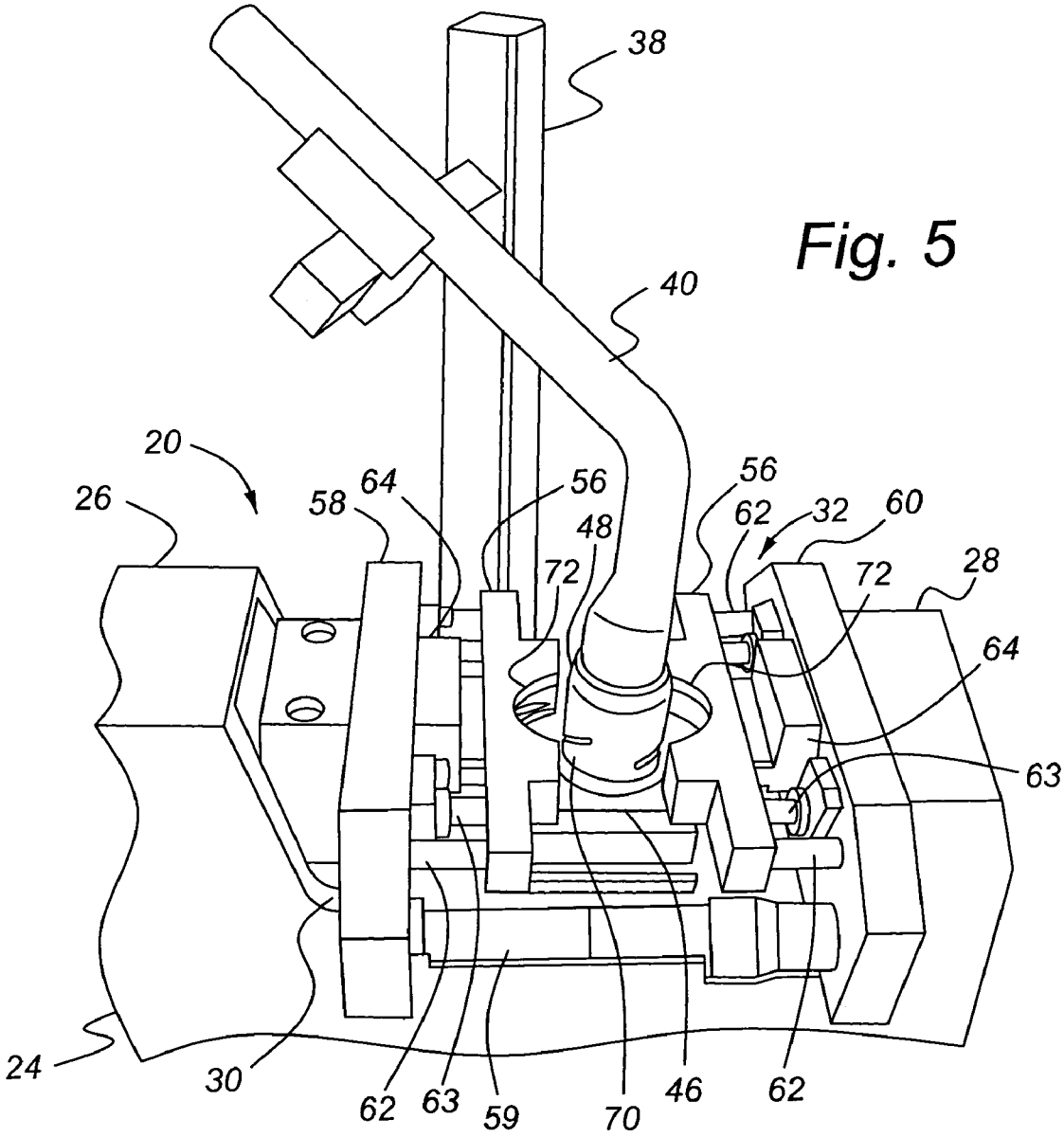
FIG. 5 is a perspective view of the thread forming apparatus with a tube mounted thereon, with the apparatus in is open, disengaged position, in accordance with an embodiment of the present invention.
Figure 6:
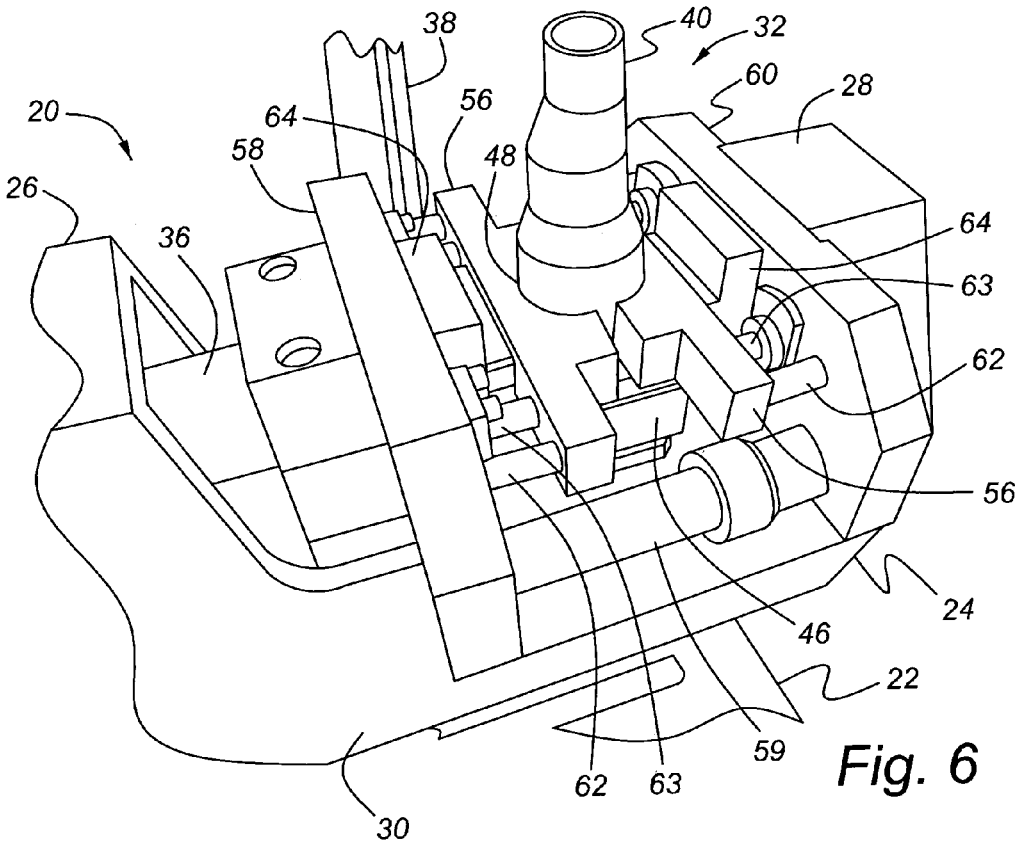
FIG. 6 is a perspective view similar to FIG. 5, but illustrating the apparatus in its closed, engaged position.
Figure 7:
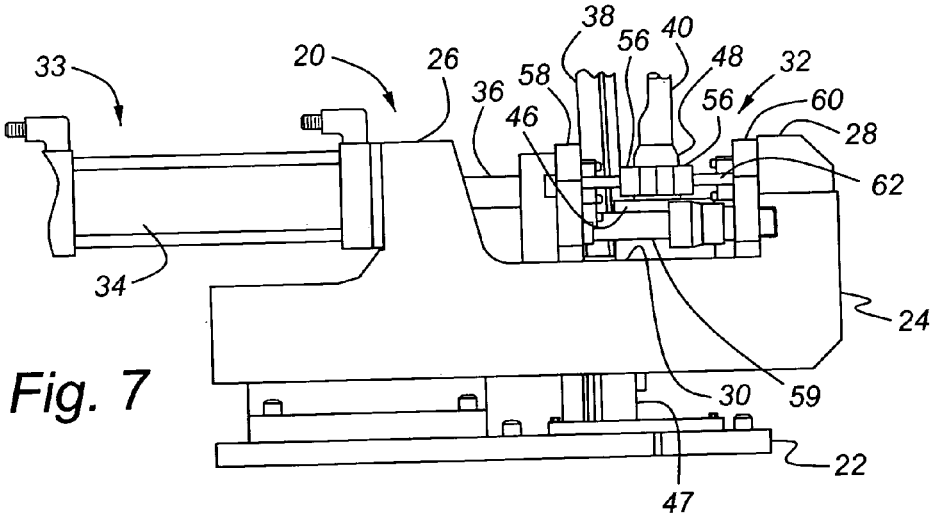
FIG. 7 is a side elevation view of the thread forming apparatus with a tube mounted thereon, with the apparatus in its closed, engaged position, in accordance with an embodiment of the present invention.

A tube support tool 38 mounts to the base 22 adjacent to the cradle 30 and is employed to provide for the initial locating and support of a tube 40 (only illustrated in FIGS. 5–7) upon which the forming operation will be performed. The tube 40 illustrated in FIGS. 5–7 is specifically employed as a fuel filler tube that extends from a vehicle fuel tank to an opening in the side of the vehicle. Although, this forming apparatus and process may be employed to form partial threads in other similar types of tubes, if so desired.

The forming assembly 32 includes a pair of internal die sections 44 extending through a hole in a support plate 46. The internal die sections 44 are shaped so that the outer surface of each extends around somewhat less than a full semi-cylinder, and sized so that, when the two are held together, the generally cylindrical shape that is formed is smaller than the inside diameter of the funnel portion (fuel filler neck portion) 48 of the tube 40. A spring (not shown) or other type of suitable mechanism biases the two internal die sections 44 into surface contact with one another. In this way, the funnel portion 48 can be easily slipped onto the internal die sections 44. In addition, each internal die section 44 also includes a recess 50, around a portion of its outer surface, that is configured to receive and shape tube material during the partial thread forming operation.

A central mandrel 52 (shown in FIG. 3) is located generally under and between the internal die sections 44, with a tapered upper end 54. The mandrel 52 is supported and can be moved up and down relative to the internal die sections 44 by a conventional linear drive mechanism (not shown). Accordingly, after a tube 40 is located over the internal die sections 44, the mandrel 52 is driven upward, which forces the two internal die sections 44 apart and into contact with the inner surface of the tube 40. This centers the tube 40 about the internal die sections 44 and holds the outer surfaces of the internal die sections 44 in surface contact with the tube 40. The support plate 46, internal die sections 44 and mandrel 52 can move relative to the other parts of this assembly by being mounted on top of and slidable relative to a central base 47. The central base 47 is secured to the main base. A biasing mechanism, such as a spring (not shown) and stop (not shown) locates these elements in their initial positions prior to the start of each thread forming operation.

Extending across either end of the forming assembly 32 are a first end plate 58 and second end plate 60. The first end plate is fixed to and movable by the shaft 36 of the pneumatic assembly 33, while the second end plate 60 is fixed to the second arm 28. The second end plate 60 is shown as being separate from the second arm 28, however, with the second end plate 60 being stationary relative to the second arm 28, it could be formed integral thereto, if so desired. Guide tubes 59 are mounted to the first end plate 58 and telescopically received through passages in the second end plate 60. The guide tubes 59 maintain the orientation of the first end plate 58 relative to the second end plate 60 as the first end plate 58 is driven toward the second 60 by the shaft 36.

Mounted to and extending outward from each end plate 58, 60 is a respective one of a pair of external die sections (halves) 64. Each die section 64 has a main flange 65 that includes a generally semi-cylindrical surface 66 with a thread forming flange 68 extending therefrom. The surfaces 66 and thread forming flanges 68 cooperates with the corresponding recesses 50 on the outer surface of the internal die sections 44 in order to form the partial threads 70 on the tube 40.

The forming assembly 32 also includes a pair of stripper pieces (external alignment clamps) 56, each engaging one of the first and second end plates 58, 60. Each stripper piece 56 engages its respective end plate 58, 60 via support shafts 62 and springs 63. Each support shaft 62 can telescope slightly relative to its corresponding end plate 58, 60, and helps support and maintain the proper orientation of its corresponding stripper piece 56. The stripper pieces 56 are biased away from the end plates 58, 60 by the springs 63. These springs 63 may be gas springs (such as nitrogen gas) or may be more conventional mechanical springs. The stripper pieces 56 also each include concave, generally semi-cylindrical surfaces 72 for making contact with and supporting the outer surface of the tube 40. The stripper pieces 56 each have a slot 74 extending therethrough, with the slots 74 being aligned with the surfaces 72. The main flanges 65 of the external die sections 64 extend through these slots 74.

The forming assembly 32 may also optionally include sensors (not shown) that may measure tube outside diameter, pressure and/or contact height during thread forming operations. Since pressure and distance measuring sensors are known to those skilled in the art, they will not be discussed further herein.

Figure 8:
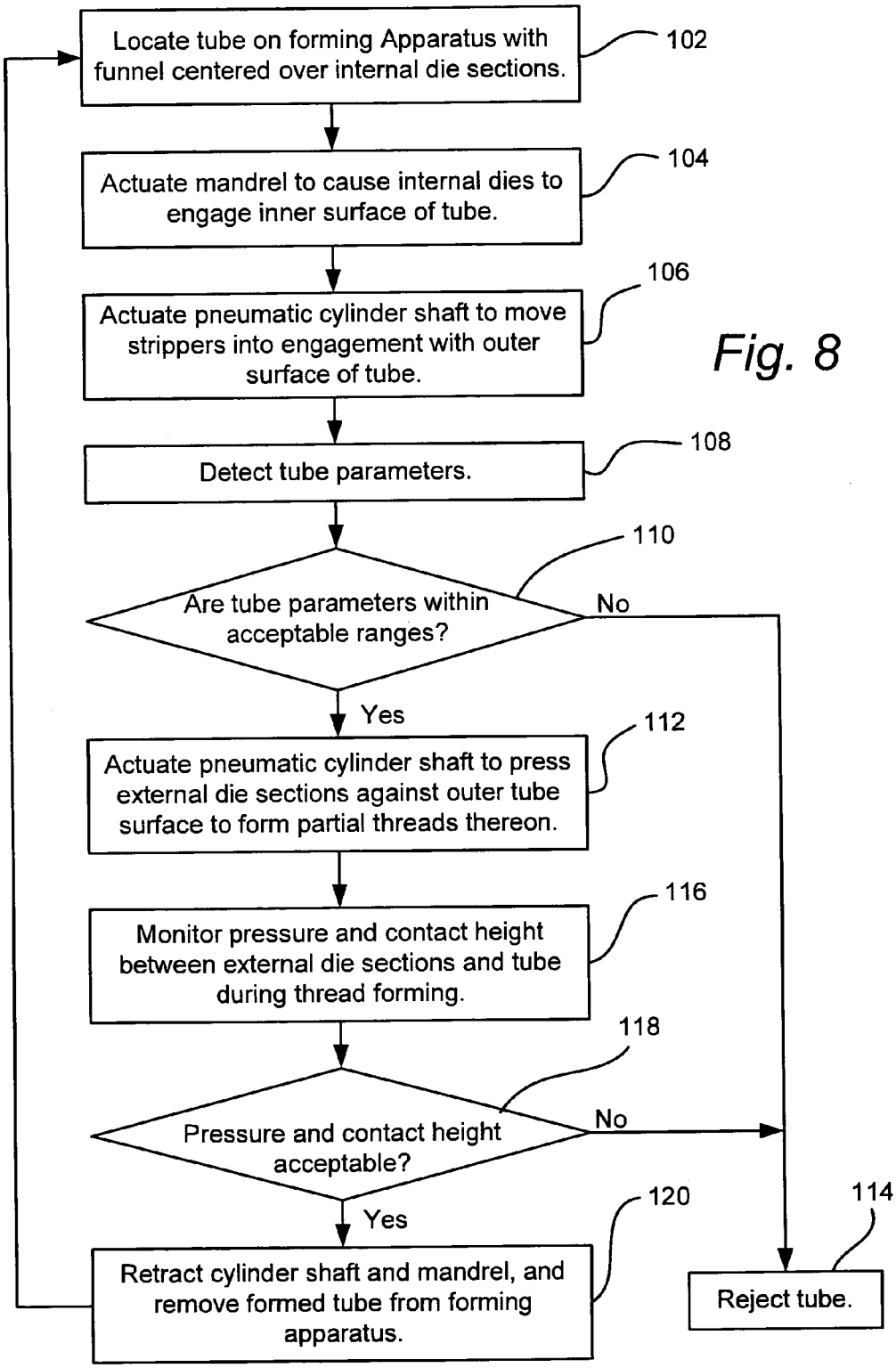
FIG. 8 is a flow chart illustrating a tube thread forming method in accordance with an embodiment of the present invention.

FIG. 8 illustrates a process of forming partial threads on a tube that may be employed by the apparatus 20, as discussed above relative to FIGS. 1–7. The process begins by locating the tube 40 on the support plate 46 and tube support 38, with the funnel portion 48 generally centered over the internal die sections 44, step 102. The mandrel 52 is actuated, moving it up between the internal die sections 44, which forces the internal die sections 44 into engagement with the inner surface of the tube 40, step 104.

The pneumatic assembly 33 is activated, which causes the cylinder shaft 36 to push against the first end plate 58. As the first end plate 58 moves, it pushes the corresponding external die section 64 and stripper piece 56, as well as the support plate 46, internal die sections 44 and mandrel 52, along with it. This movement eventually causes the semi-cylindrical surfaces 72 to engage the outer surface of the tube 40, step 106.

At this point in the process, optional steps relating to detecting out of tolerance parts may be performed. For example, a sensor (not shown) may be employed to detect the spacing between the stripper pieces 56, which corresponds to the outer diameter of the tube 40, step 108. If the outer diameter is out of an acceptable range, step 110, then the tube may be rejected, step 114. Of course, if so desired, other types of known sensors may be employed to measure other parameters for determining if the tube is acceptable.

As the pneumatic assembly 33 causes the first end plate 58 to continue moving, the springs 63 will allow the stripper pieces 56 to remain securely against and support the outside of the tube 40 without deforming or crushing the tube 40. Due to the stripper pieces 56, the tube 40 will remain seated on the support plate 46 in its proper position and orientation while the partial threads 70 are formed, and they also support the tube 40 around its periphery so that it will not deform into an oval shape during the partial thread forming process. The continued movement of the first end plate 58 will also cause the external die sections 64 to fully engage the tube 40, with the thread flanges 68 deforming tube material into the recesses 50 of the internal die sections 44, thereby forming the partial threads 70, step 112. Preferably this motion at the end of the stroke (i.e. the portion of the stroke that actually produces deformation in the tube 40) is a relatively high speed, low force motion.

At this point in the process, additional optional steps relating to detecting out of tolerance parts may be performed. For example, sensors (not shown) may be employed to detect the pressure and/or contact height between the external die sections 64 and the outer surface of the tube 40, step 116. If any of the measured parameters are out of an acceptable range, step 118, then the tube may be rejected, step 114. Such measured parameters may, for example, indicate that a particular tube has too thick or too thin of material, or that any lubricant employed is too thin.

After thread forming is complete, the pneumatic assembly 33 then retracts the shaft 36, and thus the first end plate 58. The external die section 64 and stripper piece 56 attached to the first end plate 58 will, of course, retract with the first end plate 58. Also, since the support plate 46, internal die sections 44, and mandrel 52 are biased away from the second end plate 60, they will move the tube 40 away from the stripper piece 56 and external die section 64 that are attached to the second end plate 60. Retraction of the mandrel 52 will free the tube 40 from the thread forming apparatus 20, and it can now be easily removed therefrom, step 120.

While certain embodiments of the present invention have been described in detail, those familiar with the art to which this invention relates will recognize various alternative designs and embodiments for practicing the invention as defined by the following claims.

What is claimed is:

1. A partial thread forming apparatus for forming partial threads on a tube, the apparatus comprising:

a base having a first arm and a second arm spaced from the first arm;

a prime motive apparatus fixed relative to the base and having a controllable shaft extending therefrom; and a thread forming assembly located generally between the first arm and the second arm and including a first end plate connected to and movable by the controllable shaft, a second end plate affixed to the second arm, an internal die located between the first and second end plates and sized to be insertable within the tube, a first external die mounted to the first end plate and having a first flange with a first forming surface extending toward the internal die, a second external die mounted to the second end plate and having a second flange with a second forming surface extending toward the internal die, a first stripper piece elastically coupled to the first end plate and including a first securing surface extending adjacent to the first forming surface and adapted to support the tube, and a second stripper piece elastically coupled to the second end plate and including a second securing surface extending adjacent to the second forming surface and adapted to support the tube.

2. The apparatus of claim 1 wherein the first securing surface extends adjacent to the first forming surface on opposed sides of the first flange such that the first securing surface is adapted to support the tube along two sides of the first forming surface.

3. The apparatus of claim 2 wherein the second securing surface extends adjacent to the second forming surface on opposed sides of the second flange such that the second securing surface is adapted to support the tube along two sides of the second forming surface.

4. The apparatus of claim 1 wherein the elastic coupling of the first tripper piece to the first end plate includes a gas spring.

5. The apparatus of claim 4 wherein the elastic coupling of the second stripper piece to the second end plate includes a gas spring.

6. The apparatus of claim 1 wherein the internal die includes a first half and a separate second half, and the thread forming assembly further includes a mandrel located between the first half and the second half and adapted to be operable to move the first and second halves in opposed directions into contact with the tube.

7. The apparatus of claim 1 wherein the thread forming assembly further includes a support plate extending around the internal die and adapted to support the tube thereon.

8. The apparatus of claim 7 wherein the support plate and the internal die are movable by the first end plate.

9. The apparatus of claim 1 wherein the prime motive apparatus includes a pneumatic cylinder operatively engaging the controllable shaft.

10. A partial thread forming apparatus for forming partial threads on a tube, the apparatus comprising:

a base having a first arm and a second arm spaced from the first arm;

a prime motive apparatus fixed relative to the base and having a controllable shaft extending therefrom; and a thread forming assembly located generally between the first arm and the second arm and including a first end plate connected to and movable by the controllable shaft; a second end plate affixed to the second arm; an internal die located between the first and second end plates and sized to be insertable within the tube, with the internal die including a first half and a separate second half; a mandrel located between the first half and the second half and adapted to be operable to move the first and second halves in opposed directions into contact with the tube, wherein the internal die and the mandrel are movable by the first end plate; a first external die mounted to the first end plate and having a flange extending toward the internal die; a second external die mounted to the second end plate and having a flange extending toward the internal die; a first stripper piece coupled to the first end plate and including a first securing surface adapted to support the tube; and a second stripper piece coupled to the second end plate and including a second securing surface adapted to support the tube.

11. The apparatus of claim 10 wherein the thread forming assembly further includes a support plate extending around the internal die and adapted to support the tube thereon.

12. The apparatus of claim 11 wherein the support plate, the internal die, and the mandrel are movable by the first end plate.

13. A method of forming partial threads in a tube having an inner surface and an outer surface, the method comprising the steps of:

locating a portion of the tube around an internal die having a first half and an opposed separate second half and partial teeth forming recesses located thereon;

moving the first half and the second half apart and into contact with the inner surface of the portion of the tube;

engaging the outer surface of the portion of the tube with support surfaces of a pair of opposed stripper pieces, wherein the support surfaces are elastically engaged with the outer surface of the portion of the tube;

engaging the outer surface of the portion of the tube, with a first and a second forming surface of a respective first and opposed second external die, adjacent to the corresponding support surfaces of the pair of stripper pieces to thereby form partial threads in the tube; and releasing the tube from the first and second external dies, the pair of stripper pieces and the internal die.

14. The method of claim 13 wherein the method is further defined by the tube being a fuel filler tube.

15. The method of claim 13 wherein the step of moving the first half and the second half apart is further defined by inserting a mandrel between the first half and the second half to thereby cause the first half and the second half to move apart.

16. The method of claim 13 wherein the elastic engagement is accomplished by supporting the stripper pieces with a plurality of springs.

17. The method of claim 13 wherein the steps of engaging the outer surface of the portion of the tube with support surfaces of a pair of opposed stripper pieces and engaging the outer surface of the portion of the tube with a first and a second forming surface of a respective first and opposed second external die are further defined by the engagements being generated by actuating a shaft of a pneumatic cylinder assembly.

18. The method of claim 13 further including the step of detecting a tube parameter after engaging the outer surface of the portion of the tube with support surfaces of a pair of opposed stripper pieces and prior to forming partial threads in the tube.

* * * * *